US008573146B2

(12) United States Patent
Lee et al.

(10) Patent No.: US 8,573,146 B2
(45) Date of Patent: Nov. 5, 2013

(54) SELF-PROPELLED WATERCRAFT

(75) Inventors: Tony Lee, Kingston, TN (US); Drew Gregory, Charlotte, NC (US); Scott Henderson, Kingston, TN (US)

(73) Assignee: Jackson Kayak, Inc., Sparta, TN (US)

( * ) Notice: Subject to any disclaimer, the term of this patent is extended or adjusted under 35 U.S.C. 154(b) by 196 days.

(21) Appl. No.: 13/074,891

(22) Filed: Mar. 29, 2011

(65) Prior Publication Data

US 2013/0032080 A1 Feb. 7, 2013

(51) Int. Cl.
*B63B 17/00* (2006.01)

(52) U.S. Cl.
USPC ..... 114/363

(58) Field of Classification Search
USPC ..... 114/343, 347, 363, 364
See application file for complete search history.

(56) References Cited

U.S. PATENT DOCUMENTS 4,380,208 A * 4/1983 Goserud ..... 114/363
4,730,517 A * 3/1988 Hamano et al. ..... 475/304
5,168,825 A * 12/1992 Ring ..... 114/363
5,257,590 A * 11/1993 Foote et al. ..... 114/347
5,584,733 A * 12/1996 Kobayashi ..... 440/38
7,032,531 B1 4/2006 Caples
7,121,225 B1 * 10/2006 Caples ..... 114/347

OTHER PUBLICATIONS

"Ultimate Seat Riser," Native Watercraft, http://www.nativewatercraft.com/accessory.cfm?id=28, Available at least as early as Dec. 2009, 1 page.

"Wenonah Canoe—Adjustable Seat Holders", Rutabaga Paddlesports LLC, http://www.rutabaga.com/wenonah-canoe-adjustable-seat-hangers, Product described in reference available at least as early as Jan. 2009, Accessed Aug. 5, 2013, 3 pages.

* cited by examiner

*Primary Examiner* — Daniel Venne
(74) *Attorney, Agent, or Firm* — Alleman Hall McCoy Russell & Tuttle LLP

(57) ABSTRACT

Various embodiments are disclosed herein that relate to recreational self-propelled watercraft. For example, one disclosed embodiment provides a self-propelled watercraft including a hull, a deck comprising a first seat receiver configured to support a seat at a higher position and a second seat receiver configured to support the seat at a lower position, and a seat securing mechanism configured to be operable by a user to selectively secure the seat to the deck.

20 Claims, 3 Drawing Sheets

SELF-PROPELLED WATERCRAFT

BACKGROUND

Recreational self-propelled watercraft, such as kayaks, are used for many different activities, such as touring, camping, fishing, and river running. As such, kayaks may have various design features configured to enhance various activity-specific performance characteristics. For example, a whitewater kayak may have a hull designed to enhance maneuverability, whereas a fishing kayak may have a hull configured to enhance stability. In some circumstances such specialized design features may impose limits on other aspects of performance.

SUMMARY

Various embodiments are disclosed herein that relate to recreational self-propelled watercraft. For example, one disclosed embodiment provides a self-propelled watercraft comprising a hull, a deck comprising a first seat receiver configured to support a seat at a higher position and a second seat receiver configured to support the seat at a lower position, and a seat securing mechanism configured to be operable by a user to selectively secure the seat to the deck.

Another embodiment provides a self-propelled watercraft comprising a hull, a deck, a hatch opening formed in the deck, a hatch cover configured to cover the hatch opening, and a hatch locking mechanism comprising a locking structure disposed on the hatch cover and a complementary locking structure disposed on the deck.

Yet another embodiment provides a self-propelled watercraft comprising a hull, and a deck comprising a stern end having a sloped portion that slopes downwardly toward the hull as the deck approaches the stern end, wherein the deck also comprises a groove extending along the sloped portion to the stern end, the groove being configured to accommodate a drag line.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
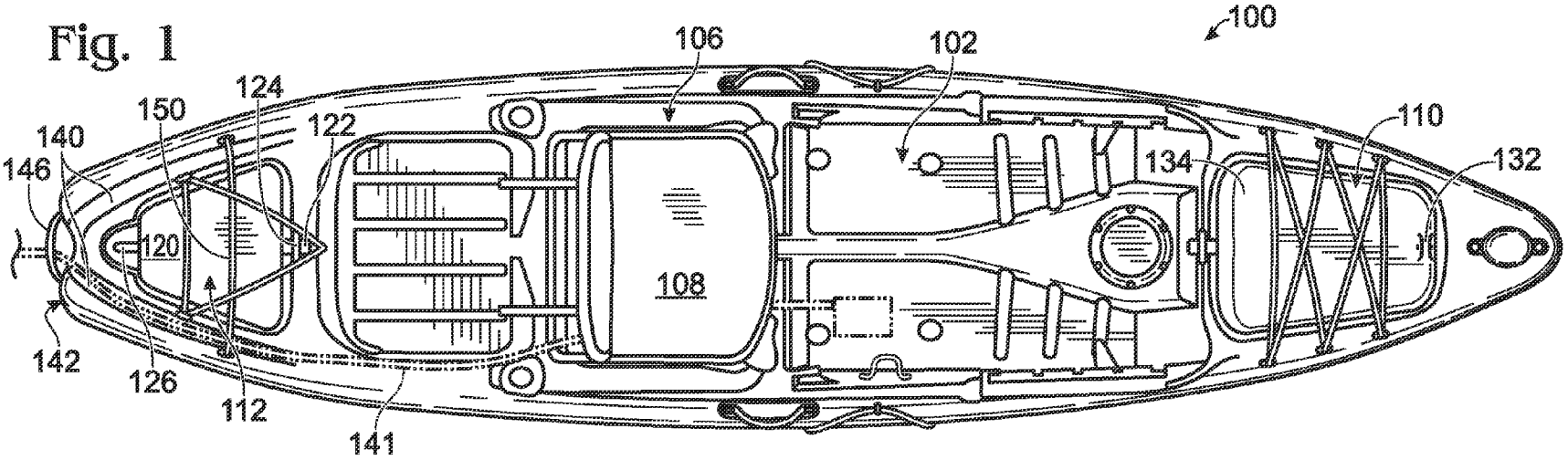
FIG. 1 shows a top view of an embodiment of a self-propelled watercraft.
Figure 2:
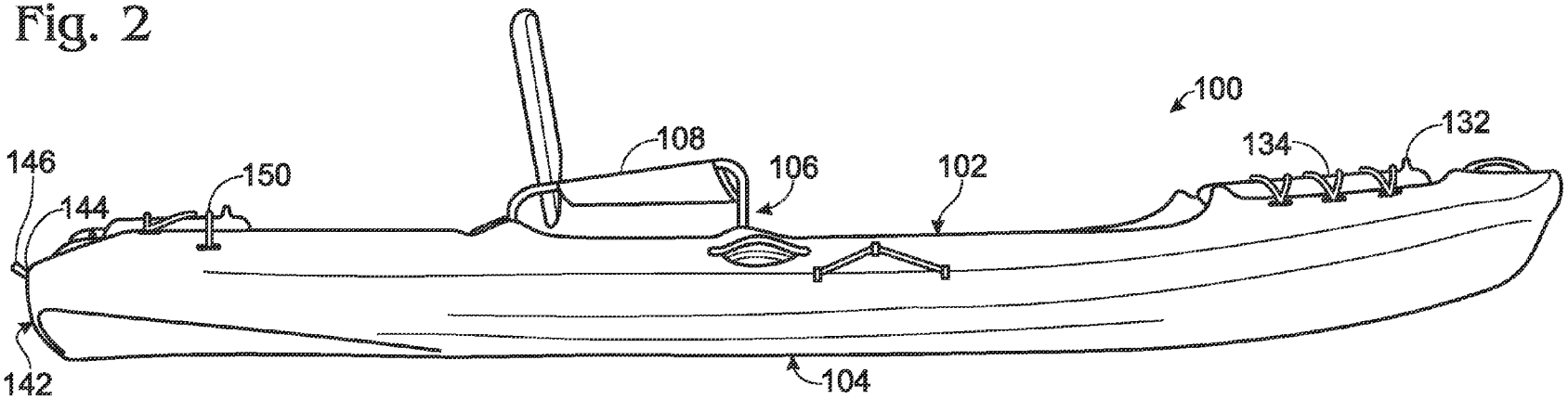
FIG. 2 shows a side view of the embodiment of FIG. 1.

FIG. 1 shows a top view of an embodiment of a self-propelled watercraft 100 in the form of a sit-on-top kayak, and FIG. 2 shows a side view of self-propelled watercraft 100. Self-propelled watercraft 100 comprises a deck 102 and a hull

104 that together define an enclosed body. The deck 102 comprises a cockpit 106 configured to accommodate a user, and a seat 108 positioned within the cockpit 106. As described in more detail below, the seat 108 is configured to be adjustable between at least a higher position and a lower position relative to an underlying surface of the deck 102. This may allow a paddler to select a desired seat position depending upon performance characteristics that are desired for current paddling conditions. For example, a user may utilize the lower position when paddling in rougher waters and/or faster currents for greater stability, and may utilize the higher position when fishing, paddling in calmer waters, or at other such times where a higher point of view may be desired. The seat 108 also may be configured to be removable, thereby allowing a user to use the seat 108 outside of the watercraft 100.

Figure 3:
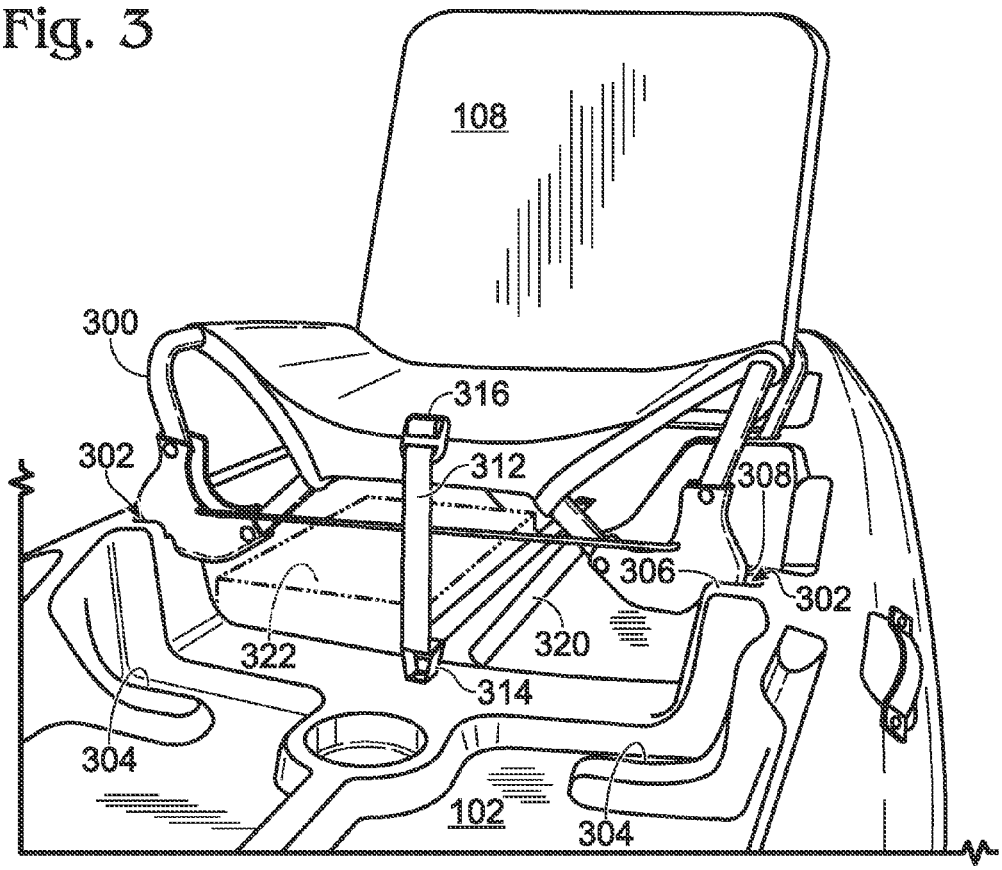
FIG. 3 shows a seat of the embodiment of FIG. 1 in a first, higher position relative to a deck of the watercraft.
Figure 4:
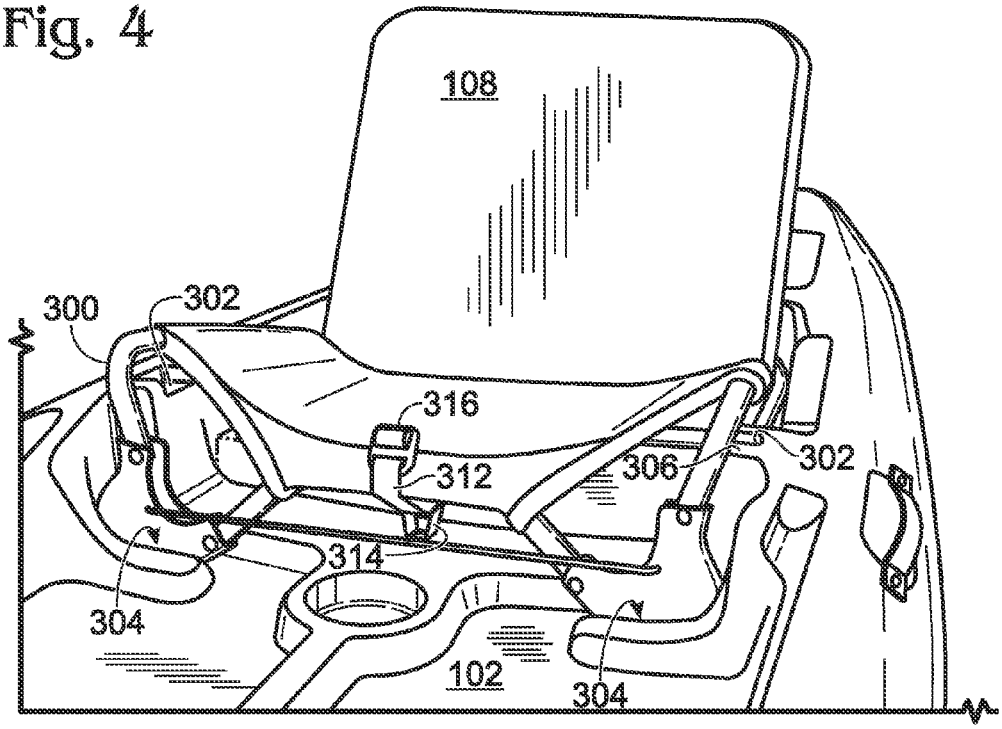
FIG. 4 shows the seat of the embodiment of FIG. 1 in a second, lower position relative to the deck.

FIG. 3 shows a view of the seat 108 in a higher position relative to an underlying surface of the deck, and FIG. 4 shows the seat 108 at a lower position relative to an underlying surface of the deck. Referring to FIG. 3, the watercraft 100 comprises a first seat receiver configured to support the seat at the higher position, and a second seat receiver configured to support the seat at the lower position. As the depicted seat 108 is supported by a plurality of legs 300, the first receiver comprises a higher support surface 302 for each leg 300, and the second receiver comprises a lower support surface 304 for each leg 300. Each support surface further comprises a front wall 306 and a back wall 308 to prevent movement of the seat 108 fore and aft along the deck 102. However, it will be understood that any other suitable structures may be used to prevent such movement of the seat 108.

In the depicted embodiment, each support surface 302, 304 is molded into the deck 102, but it will be understood that the support surfaces may be formed in any other suitable manner. For example, support surfaces may be provided via structures that are fastened to the watercraft after molding. Further, while the depicted embodiment comprises two receivers to enable two different seat heights, it will be understood that a self-propelled watercraft may have any other suitable number of receivers to enable any other suitable number of different seat heights. Additionally, in some embodiments, a seat may be configured to have a mechanically adjustable height, for example, via a telescoping mechanism, ratcheting mechanism, hydraulic mechanism, or any other suitable mechanism.

FIGS. 3-4 also show an embodiment of a seat securing mechanism configured to be operable by a user to selectively secure the seat to the deck 102. The depicted seat securing mechanism comprises a strap 312 that is coupled to a rear portion of the seat, passes through one or more loops 314 or other such structures coupled to the deck 102, and attaches to a front portion of the seat via an adjustable buckle 316. This allows the strap 312 to be tightened via the adjustable buckle 316 to secure the seat 108 to the deck 102 in either the higher or lower position. It will be understood that the depicted securing mechanism 310 is shown for the purpose of example, and is not intended to be limiting in any manner, as any other suitable structure may be used to secure the seat to the deck. For example, in other embodiments, individual securing straps, mechanical snaps, etc. may be used for each leg of the seat.

As mentioned above, the seat 108 may be configured to be removable. Referring to FIGS. 3 and 4, the seat 108 may be removed by removing the strap 312 from the adjustable buckle 316, and then removing the strap from the loops 314. In this manner, the seat may be used outside of the watercraft 100, yet quickly and easily installed in the watercraft when desired.

In some embodiments, a storage area may be formed in the deck 102 beneath the seat 108 by molding or otherwise forming a depression in the deck 102 to accommodate gear. Such a storage area may have a shape or other structural features for securing a specific item or items of equipment. In the depicted embodiment, the deck 102 comprises a tackle box storage area beneath the seat that is configured to accommodate and retain a tackle box, and to be accessible when the seat 108 is in a higher or lower position. Referring to FIG. 3, a pair of tackle box retaining structures 320 are shown beneath the seat 108—one illustrated with a tackle box 322 and the other without. In this location, the tackle box 322 is stowed securely away when a user is paddling, yet is easily accessible to the user while the user remains seated. Each depicted tackle box retaining structure 320 includes a depression having a shape of an outline of a perimeter of a tackle box. However, it will be understood that a tackle box retaining structure may have any other suitable structure configured to accommodate and retain a tackle box, such as walls extending upwardly from the deck that define a tackle box perimeter. It also will be understood that this specific example of an equipment-specific storage area is presented for the purpose of example, and is not intended to be limiting in any manner.

Referring again to FIG. 1, the self-propelled watercraft 100 also includes a front hatch 110 and a rear hatch 112 each configured to hold cargo, such as gear, food, etc. As described in more detail below, either or both of the front hatch 110 and the rear hatch 112 may be configured to be lockable, thereby allowing a user to secure gear or other items stored in the hatches. While the depicted embodiment has a front hatch and a rear hatch, it will be understood that other embodiments may have only one of a front hatch and a rear hatch, or may have more than two hatches.

Figure 5:
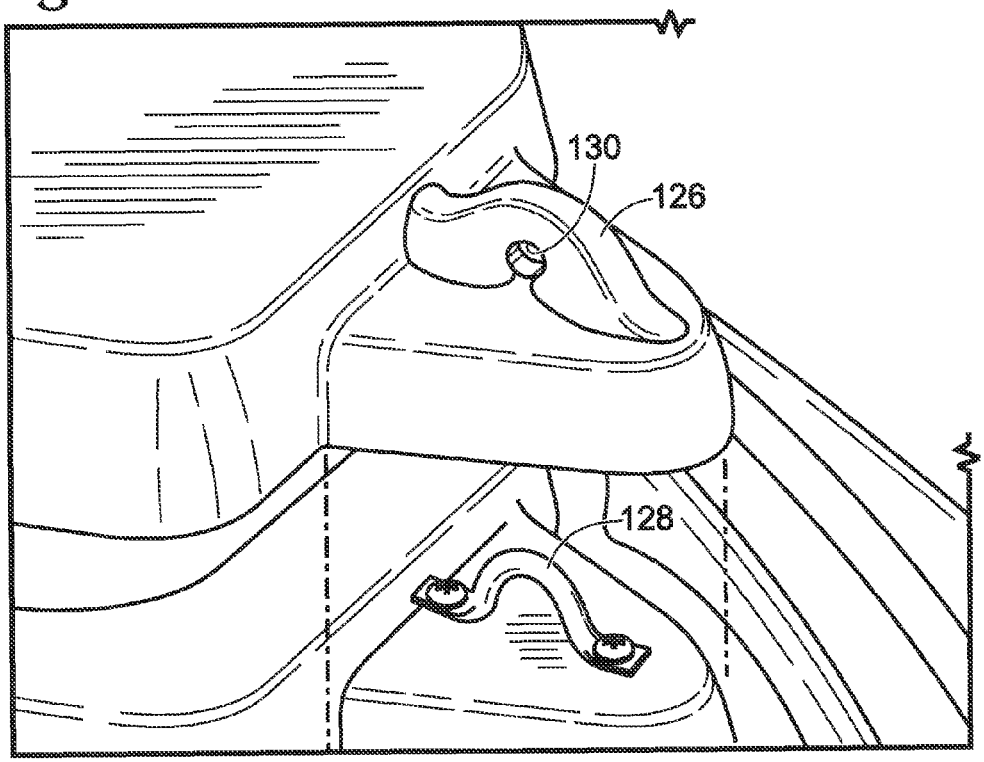
FIG. 5 shows an embodiment of a hatch locking mechanism.
Figure 6:
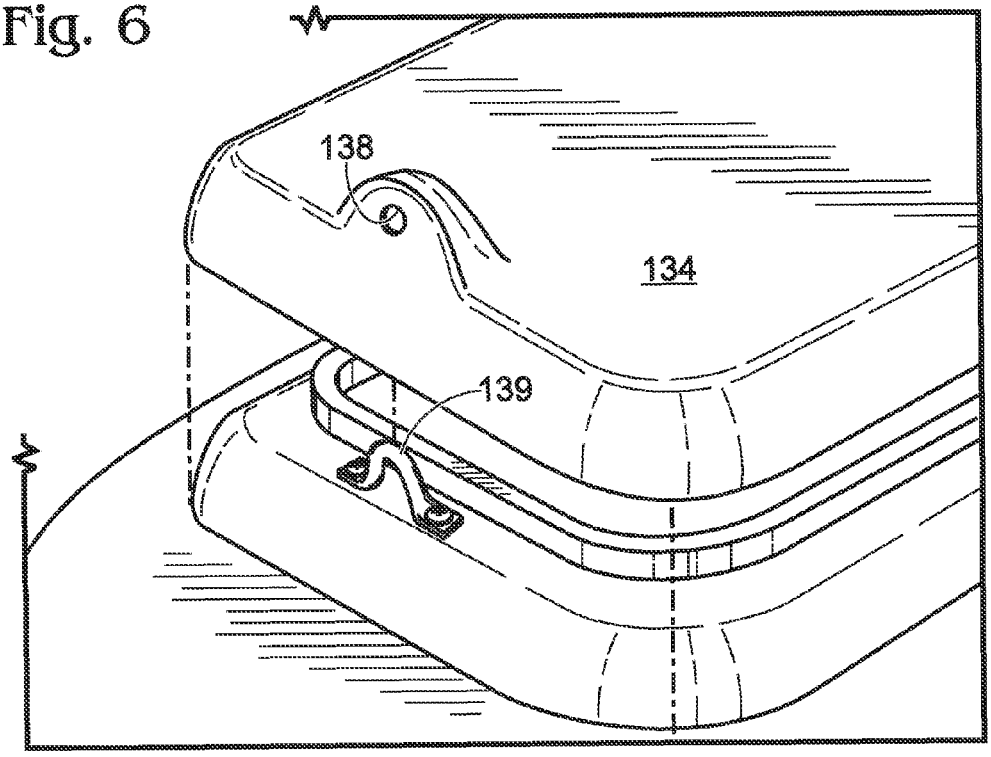
FIG. 6 shows another embodiment of a hatch locking mechanism.

Any suitable locking mechanism may be used for the hatches. For example, in the embodiment of FIGS. 1-2, the locking mechanisms for each hatch include two points of attachment for the hatch cover, wherein one of the points of attachment includes a locking structure disposed on the hatch cover and a complementary locking structure disposed on the deck. Referring to the rear hatch 112, the rear hatch cover 120 includes a first point of attachment comprising a tongue 122 that fits beneath a first bar 124 coupled to the deck 102. Further, as shown in more detail in FIG. 5, the rear hatch cover 120 includes a second point of attachment comprising a lock receptacle 126 that covers and conforms to a shape of a second bar 128 coupled to the deck 102. The lock receptacle 126 further comprises complementary holes 130 to allow a lock, such as a padlock, combination lock, etc. to be passed through the lock receptacle 126 and under the second bar 128 to lock the rear hatch cover 120 to the deck 102. FIG. 6 shows a hatch locking mechanism for the front hatch cover 134, wherein a bar 136 and complementary holes 138 have a different orientation to the centerline of the boat than those for the rear hatch cover. It will be understood that the depicted locking structures are shown for the purpose of example and are not intended to be limiting in any manner.

Referring again to FIG. 1, the self-propelled watercraft 100 further includes one or more grooves 140 configured to accommodate a drag line or anchor line (illustrated at 141 in FIG. 1) configured to slow or prevent movement of the self-propelled watercraft 100 through water. The term "drag line" is used herein to refer to any such structure, including but not limited to anchors lines, drag lines and drag chains. Such a drag line may be used, for example, when fishing to slow downstream progress. Referring to FIG. 2, the deck 102 comprises a stern end 142 having a sloped portion 144 that slopes downwardly toward the hull 104 as the deck 102 approaches the stern end. Each groove 140 extends along this sloped portion 144, thereby allowing the drag line 141 to be lowered via gravity by a user sitting in the cockpit 106 without the drag line falling to the side of the deck 102.

In some embodiments, a drag line retainer 146 may extend from the deck or hull over the groove to form a closed loop through which a drag line may be extended. This may help to prevent the drag line from falling to the side of the watercraft, as having a drag chain hang (or other drag line) from the side of the watercraft may negatively impact controllability while paddling or drifting at a reduced speed relative to a river current. In the depicted embodiment, the drag line retainer 146 takes the form of a grab loop that a user may hold to lift or pull the watercraft 100. However, in other embodiments, the drag line retainer 146 may take any other suitable form, may have any other suitable location (e.g. along the deck between the cockpit and the stern, such as over each groove 140), or may be omitted. Further, other structures also may help to hold a drag line within a groove 140. For example, referring to FIG. 1, one or more hatch cover hold-down cords 150 of the rear hatch may extend over grooves 140, and therefore may help to hold a drag line in place.

The deck may include any suitable number of grooves for accommodating drag lines. For example, the depicted watercraft 100 comprises a first groove located closer to a first side of the deck than a second side of the deck, and also comprises a second groove located closer to a second side of the deck than a first side of the deck. This allows a user to control the drag line from either side of the cockpit. However, other embodiments may have a single groove positioned in any suitable location, or more than two grooves.

It is to be understood that the specific embodiments of self-propelled watercraft described herein are presented for the purpose of example, and that these specific embodiments or examples are not to be considered in a limiting sense, because numerous variations are possible. The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A self-propelled watercraft, comprising:

a hull;

a seat;

a deck;

a first seat receiver disposed on the deck and configured to support the seat at a higher position relative to an underlying surface of the deck, the first seat receiver including a first, higher seat support surface for a leg of the seat and also including one or more walls that prevent movement of the seat alone the deck when the seat is in the higher position, and a second seat receiver disposed on the deck and configured to support the seat at a lower position relative to the first seat receiver, the second seat receiver including a second, lower support surface for the leg of the seat and also including one or more walls that prevent movement of the seat fore and aft when the seat is in the lower position.

2. The self-propelled watercraft of claim 1, wherein the first seat receiver is molded into the deck of the watercraft.

3. The self-propelled watercraft of claim 1, wherein the seat is removable.

4. The self-propelled watercraft of claim 1, wherein the seat comprises a plurality of legs, and wherein the first seat receiver and the second seat receiver include a support surface for each leg of the seat.

5. The self-propelled watercraft of claim 1, further comprising a seat securing mechanism operable by a user to selectively secure the seat to the deck.

6. The self-propelled watercraft of claim 1, wherein the deck comprises a plurality of walls located beneath the seat and defining an outline of a perimeter of a tackle box.

7. The self-propelled watercraft of claim 5, wherein the seat securing mechanism comprises a strap releasably coupled between the seat and the deck.

8. The self-propelled watercraft of claim 1, wherein the deck comprises a lockable hatch.

9. The self-propelled watercraft of claim 1, wherein the deck comprises a stern end having a sloped portion that slopes downwardly toward the hull as the deck approaches the stern end, and wherein the deck also comprises a groove extending along the sloped portion to the stern end, the groove being configured to accommodate a drag line.

10. A self-propelled watercraft, comprising:

a hull;

a seat;

a deck, comprising:

a first seat receiver configured to support the seat at a higher position relative to an underlying surface of the deck, the first seat receiver including a first, higher seat support surface for a leg of the seat and also including one or more walls that prevent movement of the seat fore and aft when the seat is in the higher position, and a second seat receiver configured to support the seat at a lower position relative to the underlying surface of the deck, the second seat receiver including a second, lower support surface for the leg of the seat and also including one or more walls that prevent movement of the seat fore and aft when the seat is in the lower position; and a seat securing mechanism configured to be operable by a user to selectively secure the seat to the deck.

11. The self-propelled watercraft of claim 10, wherein the first seat receiver is located behind the second seat receiver along a direction from a bow to a stern of the self-propelled watercraft.

12. The self-propelled watercraft of claim 10, wherein the seat is removable.

13. The self-propelled watercraft of claim 10, wherein the seat comprises a plurality of legs, and wherein the first seat receiver and the second seat receiver together include a corresponding plurality of support surfaces.

14. The self-propelled watercraft of claim 10, wherein the deck comprises a plurality of walls located beneath the seat and defining an outline of a perimeter of a tackle box.

15. The self-propelled watercraft of claim 10, wherein the seat securing mechanism comprises a strap releasably coupled between the seat and the deck.

16. The self-propelled watercraft of claim 10, wherein the deck comprises a lockable hatch.

17. The self-propelled watercraft of claim 10, wherein the deck comprises a stern end having a sloped portion that slopes downwardly toward the hull as the deck approaches the stern end, and wherein the deck also comprises a groove extending along the sloped portion to the stern end, the groove being configured to accommodate a drag line.

18. A self-propelled watercraft, comprising:

a hull;

a seat; and a deck comprising:

a first seat receiver molded into the deck, the first seat receiver comprising a first, higher seat support surface for a leg of the seat and also including first front and rear walls that prevent movement of the seat fore and aft when the seat is in a higher position, and a second seat receiver molded into the deck, the second seat receiver including a second, lower support surface for the leg of the seat and also including second front and rear walls that prevent movement of the seat fore and aft when the seat is in a lower position.

19. The self-propelled watercraft of claim 18, further comprising a seat securing mechanism operable to selectively secure the seat to the deck.

20. The self-propelled watercraft of claim 18, wherein the seat comprises a plurality of legs, and wherein the first seat receiver and the second seat receiver together include a corresponding plurality of support surfaces.

* * * * *